United States Patent [19]

Burstrom

[11] 4,238,636

[45] Dec. 9, 1980

[54] HEATER FOR RESISTANCE FURNACES

[75] Inventor: Martin Burstrom, Robertsfors, Sweden

[73] Assignee: ASEA Aktiebolag, Vesteras, Sweden

[21] Appl. No.: 20,479

[22] Filed: Mar. 14, 1979

[30] Foreign Application Priority Data

Mar. 20, 1978 [SE] Sweden ..... 7803149

[51] Int. Cl.[3] ..... H05B 3/06; H05B 3/34

[52] U.S. Cl. ..... 13/25; 338/282; 338/286; 338/294; 338/298

[58] Field of Search ..... 13/25; 338/282, 286, 338/294, 298, 287

[56] References Cited

U.S. PATENT DOCUMENTS 424,047 3/1890 Butterfield et al. ..... 338/287 X 3,420,985 1/1969 Andersen et al. ..... 13/25 X

FOREIGN PATENT DOCUMENTS 2275104 2/1976 France ..... 338/287

*Primary Examiner*—Roy N. Envall, Jr.

*Attorney, Agent, or Firm*—Watson, Cole, Grindle & Watson

[57] ABSTRACT

The present invention relates to a heater, primarily for pressure furnaces for extremely high temperatures for isostatic compression. The resistance elements of the heater are arranged between two metal rings at different levels which are supported by conductors. The resistance elements comprise two groups of wires arranged in a righthand and a lefthand spiral, respectively. The wires are joined together at the intersection points by means of lashing.

6 Claims, 4 Drawing Figures

HEATER FOR RESISTANCE FURNACES

BACKGROUND

1. Field of the Invention

The present invention relates to a heater for resistance-heated furnaces in which material is simultaneously treated at high temperature, preferably a temperature above 1000° C., and high pressure, preferably in a gaseous atmosphere with a pressure above 500 bar.

2. Prior Art

In furnaces for extremely high temperatures, ceramic constructions in heaters to support resistance elements do not withstand the stresses occurring. The tendency to crack is considerable and is caused both by temperature alterations and pressure changes during a work cycle. In furnaces for temperatures higher than about 1400° C., therefore, a heater constructed entirely of metallic material is used. In one known design a heating section comprises two semi-circular, horizontally directed arcs at the upper part of the section, each arc being supported by three vertical conductors. Between these arcs and a ring arranged under the arcs are a number of vertical resistance elements. These may be either straight or bent in zig-zag shape. The ring may be suspended in these resistance elements. Current is conducted to an arc and flows through the resistance elements to the ring, and to the resistance elements which are connected to the other arc and through the supporting conductors, back to the equipment supplying the current. Because of the asymmetry of the arcs, for instance, and the asymmetrical positioning of their support members, it has proved difficult to control thermal movement. The deformation occurring may cause short-circuits and other undesirable effects.

SUMMARY OF THE INVENTION

The invention relates to an improvement in the design of a heater made entirely of metal. This heater is provided with an upper and a lower feed ring located in a heating zone, each ring being supported by three or more vertical conductors. A number of resistance wires run between these rings and are divided into two groups forming a righthand and a lefthand spiral, respectively, between the attachment points in the rings. The diameter of these spirals is substantially equal to the diameter of the feed rings. The wires in the two wire groups are joined together at at least some of the intersection points. They may be joined together by means of lashing in such a way that alterations in the angles at the intersection points are counteracted. The resistance wires form a mesh cylinder which is satisfactorily stable in shape, and the entire construction offers unprecedented stability.

BRIEF DESCRIPTION OF THE FIGURES

The invention will be explained further with reference to the accompanying Figures.

DETAILED DESCRIPTION

Figure 1:
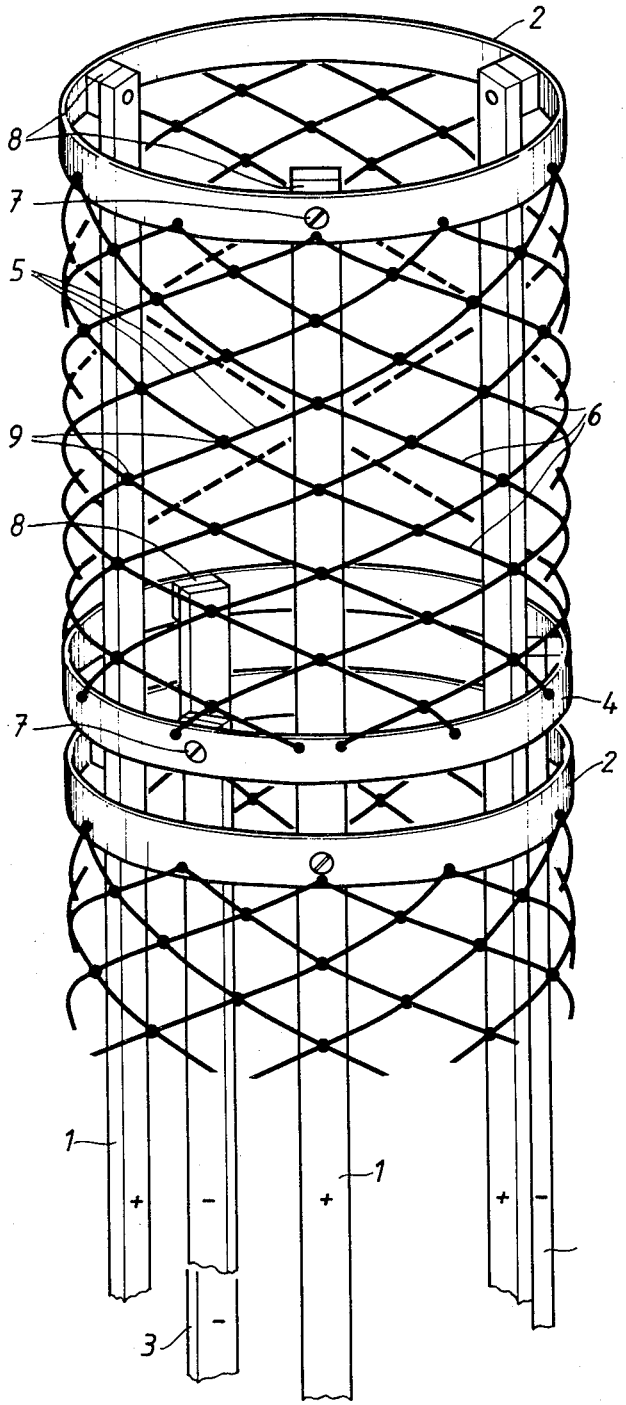
FIG. 1 shows the upper part of a heater.

In the Figures, numeral 1 designates conductors supporting upper rings 2 in two heater sections and numeral 3 designates conductors supporting lower rings 4 therein. Between upper ring 2 and lower ring 4 in a heater section are resistance elements in the form of two groups of wires 5 and 6 which form spirals having substantially the same diameter as rings 2 and 4. Seen from above, wires 5 form a righthand spiral and wires 6 a lefthand spiral. Rings 2 and 4 are connected to conductors 1 and 3 by screws or rivets 7 and spacing elements 8 so that the required radial insulating distance is obtained between conductors 1 and rings 4 and between conductors 3 and rings 2.

Figure 2:
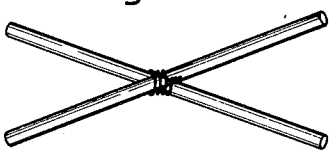
FIGS. 2–4 show the lashed intersection points on a larger scale.
Figure 3:
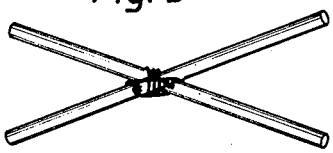
Figure 4:
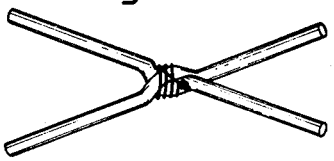

Wires 5 and 6 in the groups of wires crossing over each other are lashed at intersection points 9 so that a mesh with reinforced tie-points is obtained, and alterations in the angle of intersection are counteracted to a greater or lesser extent. This lashing may be performed in various ways, as shown in FIGS. 2–4. Simple lashing as shown in FIG. 2 gives stability but permits a certain amount of angular movement, whereas lashing performed in accordance with FIG. 3, where the wires run both horizontally and vertically, offers an extremely firm tie-point. To prevent axial displacement the wires may be bent at the points of intersection and secured by means of lashing in accordance with FIG. 4.

What is claimed is:

1. Heater for furnaces, comprising:

first and second ring-like power-feed elements;

at least one first and at least one second current conductor for respectively supporting said first and second ring-like power-feed elements;

a first group of wire-like resistance elements wound in a righthand spiral between said first and second ring-like power-feed elements;

a second group of wire-like resistance elements wound in a lefthand spiral between said first and second ring-like power-feed elements and forming intersections with said first group of wire-like resistance elements; and means for retaining the wire-like resistance elements of said first and second groups at said intersections.

2. A heater as in claim 1 wherein the diameter of said first and second group of wire-like resistance elements is substantially equal to the diameter of said first and second ring-like power-feed elements.

3. A heater as in either claim 1 or 2 wherein said means for retaining are wire lashings wound around at least some of said intersections in a direction substantially transverse to the intersections of said first and second group of wire-like resistance elements.

4. A heater as in either claim 1 or 2 wherein said means for retaining are wire lashings wound around at least some of said intersections in a direction substantially transverse and in a direction substantially parallel to the intersections of said first and second group of wire-like resistance elements.

5. A heater as in either claim 1 or 2 wherein wire-like resistance elements in both said first and second group include a bent portion at said intersection such that the bent portion of said first group of wire-like resistance elements nests within the bent portion of said second group of wire-like resistance elements at said intersections.

6. A heater as in claim 5 wherein said means for retaining is wire wound around at least some of said intersections in a direction substantially transverse to the intersections of said first and second group of wire-like resistance elements.

* * * * *